United States Patent [19]

Horvath, Jr. et al.

[11] 3,997,370

[45] Dec. 14, 1976

[54] METHOD OF HOT REDUCING FERROUS AND FERROUS ALLOY PRODUCTS WITH COMPOSITE MARTENSITIC NODULAR CAST CHILL IRON ROLLS

[75] Inventors: Paul J. Horvath, Jr., Whitehall; John A. Gibbon, Center Valley, both of Pa.

[73] Assignee: Bethlehem Steel Corporation, Bethlehem, Pa.

[22] Filed: Nov. 17, 1975

[21] Appl. No.: 632,872

[52] U.S. Cl. ..... 148/12 R; 29/132; 29/196.1; 148/34

[51] Int. Cl.[2] ..... C22F

[58] Field of Search ..... 148/34, 12.4, 12.1, 148/12.3, 12 D, 12 F, 12 EA, 12 E, 12 A; 29/196.1, 148.4, 132

[56] References Cited

UNITED STATES PATENTS

| | | | |
|---|---|---|---|
| 2,129,683 | 9/1938 | Gontermann et al. | 148/34 |
| 3,623,850 | 11/1971 | Horvath, Jr. | 148/34 |
| 3,670,381 | 6/1972 | Schoffmann | 29/132 |
| 3,855,015 | 12/1974 | Nemoto et al. | 148/34 |
| 3,894,325 | 7/1975 | Maruta et al. | 148/34 |

*Primary Examiner*—W. Stallard

*Attorney, Agent, or Firm*—Joseph J. O'Keefe; William B. Noll

[57] ABSTRACT

This invention is directed to a method of hot reducing ferrous and ferrous alloy products, such as plates, strip, bars and rods, where such products are heated to temperatures in excess of 1900° F and subsequently reduced at temperatures within the range of about 900° and the initial heating temperature. More particularly, this invention relates to the method of effecting said hot reducing at such temperatures by means of composite, martensitic, nodular graphite chill cast iron rolls. Such rolls are characterized by (1) an average surface hardness of at least about 76 Shore-C, (2) a thermal-crack-resistant chill cast surface portion consisting essentially of, by weight, about 3.00% to 3.70% carbon, about 0.35% to 1.25% manganese, about 1.0% to 2.0% silicon, about 3.75% to 5.75% nickel, about 0.75% to 1.35% chromium, about 0.40 to 1.10% molybdenum, about 0.3% to 0.08% magnesium, balance iron and incidential impurities, and (3) a core portion comprising a ferrous alloy.

5 Claims, No Drawings

METHOD OF HOT REDUCING FERROUS AND FERROUS ALLOY PRODUCTS WITH COMPOSITE MARTENSITIC NODULAR CAST CHILL IRON ROLLS

BACKGROUND OF THE INVENTION

This invention is directed to an improved composite chill cast iron roll of the type disclosed in U.S. Pat. No. 3,623,850, issued Nov. 30, 1971 to Paul J. Horvath, Jr. More particularly this invention relates to a new use of such rolls in the hot reduction of ferrous and ferrous alloy products, such as plates, strip, bars and rods. These rolls, as a result of the combination of chemistry, manufacturing sequence, and post treatment, may be characterized as composite martensitic, nodular graphite, chill-cast iron rolls.

Since the original development by Horvath, such rolls have gained much notoriety for their performance in cold mills, or in cold rolling applications. Their outstanding performance has been attributed to the ability of such rolls to resist marking, bruising and spalling, while being readily redressed for further service. However, with cold rolling applications, heat, hence thermal fatigue and cracking, is not a problem.

Rolling mill design has developed over the years into a complex science having many facets to it. For example, cold rolling applications, such as reviewed in U.S. Pat. No. 3,623,850, and hot rolling applications are just two of such facets. Different criteria must be used to determine roll design, such as material selection, properties and capabilities of the roll. In other words, a roll was designed for a specific rolling application because it possessed the properties needed for such application. As indicated above, resistance to thermal fatigue or cracking is a major consideration in determining suitability of a roll for use in hot rolling applications. As a consequence, roll manufacturers, when designing rolls for hot mill applications, particularly for the first several stands of a hot strip mill where the strip temperatures exceed about 1800° F, maintained the shell hardness below a specified value.

In the publication, *Roll Specifications For Finishing Stands of a Modern Continuous Hot Strip Mill*, by John M. Dugan, published by the Association of Iron and Steel Engineers, copyright 1970, the author indicates that the shell hardness of the rolls in the initial stand vs. final stand of a hot mill finishing train will vary by about 7 points on the shore "C" hardness scale. That is, where the temperature of the strip is hottest, the lower hardness roll, i.e. about 75 shore C, is used.

While the shell hardness of a work roll is a prime consideration in the selection of a roll, there are others. For instance, the article entitled, "Cause and Prevention of Hot Strip Work Roll Banding," by Charles E. Peterson and published in the Iron and Steel Engineer Year Book, 1956, offers three possible solutions to the banding problem in a hot mill. Banding, as defined by the author "occurs primarily on the rolls of the first two finishing stands, [and] is caused by the adhesion of sizeable patches of scale on the roll surface. Generally the scale patches are elongated in the direction of rolling, giving the appearance of bands." His solution is (1) effective scale removal from the strip, (2) selection of roll material combining high hardness with freedom from graphite, and (3) adequate coolant to keep rolls as cold as possible.

Faced with these prejudices, the prior art settled for cast steel rolls, a graphite free roll having a nominal composition of 1.7C —1.0-Cr—1.7Ni-Fe. However, such rolls are limited in the quantity of product that can be rolled, and by the frequent dressing required to prepare the roll once again for service. To improve the usable work life of their rolls, roll makers began to look to high chromium rolls. Typically these rolls contain about 12 to 20% chromium and are characterized by a Shore-C hardness of between about 60 and 75. While the usable life of a hot mill roll had been increased with the introduction of the high-chromium roll, the premium cost of the highly alloyed chromium rolls made their selection a costly alternative. Moreover, the high chromium roll is sensitive to thermal conditions in the mill and thereby frequently requiring cutdowns because of excessive fire cracking.

Confronted by these facts, including the high cost of an alternative answer, a different approach was needed. It was discovered that a cast iron roll, having a shell portion containing nodular graphite in a martensitic matrix, with an average surface hardness of at least 76 Shore-C, could be used effectively in the hot reduction of ferrous and ferrous alloy products, such as strip, plates, bars and sheet. This was particularly dramatic where the temperatures of the workpiece exceeded about 1800° F. Finally, the cost of such rolls was comparable to that of the presently used cast steel or cast iron rolls, and considerably below the cost of the chromium rolls.

BRIEF SUMMARY OF THE INVENTION

This invention is directed to a new use for a composite martensitic, nodular graphite, chill-cast iron roll, more particularly to the method of using such roll for the hot reduction of ferrous and ferrous alloy products, such as plates, strip, bars and rods. In hot rolling applications where the work rolls come in contact with a workpiece which has been heated prior to reduction to temperatures in excess of 2200° F, thermal shock, resulting in cracking, can occur.

The present invention is the result of the discovery that a composite martensitic, nodular graphite, chill-cast iron roll is resistant to thermal cracking while possessing the further attributes necessary for a work roll in a hot rolling application. The roll of this invention is characterized by a surface portion having a hardness of at least 76 Shore-C and consisting essentially of, by weight, about 3.00 to 3.70% carbon, about 0.35 to 1.25% manganese, about 1.0 to 2.0% silicon, about 3.75 to 5.75% nickel, about 0.75 to 1.35% chromium, about 0.40 to 1.10% molybdenum, about 0.03 to 0.08% magnesium, the balance iron and incidental impurities, and a core portion comprising a ferrous alloy whose chemistry and mechanical properties are metallurgically compatible with the chemistry and properties of said surface portion.

DESCRIPTION OF PREFERRED EMBODIMENT

The work roll of this invention, for which a new use has been found in hot rolling applications, may be characterized as a composite martensitic, nodular graphite, chill-cast iron roll. Such roll is comprised of a thermal-crack-resistant annular chill surface portion consisting essentially of, by weight, about 3.00% to 3.70% carbon, about 0.35% to 1.25% manganese, about 1.0% to 2.0% silicon, about 3.75% to 5.75% nickel, about 0.75% to 1.35% chromium, about 0.40% to 1.10% molybdenum, about 0.03% to 0.08% magnesium, balance iron and incidental impurities, whose surface has a hardness of at least 76 Shore-C, and a core portion comprising a cast iron or ferrous alloy.

Within such broad composition range there is a preferred chemistry to give optimum properties, namely,

| | |
|---|---|
| Carbon | 3.10% to 3.40% |
| Manganese | 0.45% to 0.75% |
| Silicon | 1.35% to 1.65% |
| Nickel | 3.90% to 4.30% |
| Chromium | 0.90% to 1.30% |
| Molybdenum | 0.55% to 0.80% |
| Magnesium | 0.03% to 0.08% |
| Iron | balance. |

It will be appreciated that within the broad and preferred chemistry ranges a proper relationship must be established among the several elements. For instance, several of the elements are critical in the formation and depth of the chill portion containing nodular graphite. Carbon must be present in an amount over and above that which will form as carbides. Thus, if such carbide forming elements as chromium is present near the leaner end of the range of 0.75% to 1.35%, carbon may likewise be present in an amount near 3.00%.

The excess carbon, over and above that which forms as carbide, and silicon are the primary elements which promote the depth of the chill. Very high carbon and high silicon increase the amount of graphite formed thereby leading to a decrease in the depth of chill. Further, silicon in excessive amounts results in the undesirable formation of soft pearlite in the microstructure.

As indicated previously, optimum properties and performance are achieved through a proper balance of the chemistry. In the manner of carbon and silicon, and each further elemental addition acts individually or synergistically with another to enhance the properties or performance of the roll in a hot rolling application. For example, nickel in the iron helps to suppress pearlite formation while promoting the development of martensite. The high surface hardness of the rolls of this invention is gained through the additions of chromium and molybdenum. Chromium forms a stable carbide thereby assuring a proper balance between the nodular graphite and carbides in the chill portion of the roll. Molybdenum, on the other hand, increases the resistance of the roll's surface to spalling. Finally, magnesium is added to the chemistry of the chill portion to promote the formation of nodular graphite.

All of the preceding discussion has been directed to the chill portion of the composite cast iron roll. However, the greater bulk of the roll is the core portion. Early in the development of composite martensitic nodular graphite cast iron rolls there was considerable concern over the "marriage" between the chill portion and core portion. The outgrowth of this concern resulted in the preferred selection of a low alloy cast iron. By way of example, a preferred chemistry for the core was established, such chemistry consists essentially of, by weight.

| | |
|---|---|
| Carbon | 3.30% to 3.60% |
| Manganese | 0.40% to 0.70% |
| Phosphorus | 0.10% max. |
| Sulfur | 0.05% max. |
| Silicon | 1.15% to 1.45% |
| Nickel | 0.60% to 1.40% |

-continued

| | |
|---|---|
| Chromium | 0.15% to 0.65% |
| Iron | balance. |

It has now been discovered that a suitable marriage can be made between the chill portion and a core portion whose chemistry varies from that given above. That is, variations to the core chemistry may be made so long as the core can withstand the rigors of a hot rolling application. As the core of a roll it must possess sufficient strength, ductility and toughness, the levels of which are well known. Additionally, the core must be machinable to provide proper journaling of the roll, while being wear resistant. A final factor in determining whether a suitable marriage can be effected between the chill portion and the core portion is the pouring practice. Two well known methods of manufacturing composite rolls are the centrifugally cast roll and the static sequential double poured rolls. Within each method the individual capabilities or pouring practices of a given roll foundry can effect the soundness of the roll, hence the marriage between the chill portion and the core portion. Thus, while the above tabular listing for the core chemistry is preferred, it should not be read as a limitation on this invention.

Following the selection of a balanced chemistry for the chill-cast surface portion and a core chemistry metallurgically compatible therewith, a roll may be cast in a manner known in the art. After soldification and cooling, the as-cast roll is subjected to a stress-relief treatment in the manner taught in U.S. Pat. No. 3,623,850. The roll may then be machined and dressed for use in hot rolling applications.

In order to establish the effectiveness of the roll of this invention under the severe temperature conditions of a hot strip mill, a lengthy trial was conducted on a hot strip mill. The trial covered seventeen weeks using rolls of the type described herein and rolls of the high-chromium variety. The purpose of the trial was to determine the maximum tonnage that could be rolled consistent with good surface quality with each roll. Typical analyses and hardnesses of the rolls in this trial are listed in Table I.

TABLE I

| | Type Roll | |
|---|---|---|
| | A*-High-Chromium | B**-Invention |
| Total Carbon | 2.52 | 3.35 |
| Mn | .72 | .57 |
| P | .046 | .050 |
| S | .044 | .006 |
| Si | .50 | 1.52 |
| Ni | .39 | 4.05 |
| Cr | 15.51 | .99 |
| Mo | 2.41 | .65 |
| Mg | — | .05 |
| Hardness Shore "C" | 74 | 79 |

*Commercially produced centrifugally cast roll - clear-chill iron roll with graphite-free white iron structure containing chromium carbides.

**Static sequential double poured roll - indefinite-chill iron roll containing nodular graphite in a predominantly martensitic structure.

This rolling trial was limited to tinplate because this presents one of the most demanding roll applications and also to eliminate variables arising from product mix. Maximum strip width rolled was 40 inches (0.074 inch and 0.080 inch gauge). Roll lubrication was not used during the trial. Past experience on this mill had found that the maximum rollings of tinplate, using steel cast rolls, were limited to about 750–1000 tons/run. Finally, on this hot strip mill which contains seven finish rolling stands in tandem, typical temperatures for the processing of tinplate in the finish rolling stands varies between 1900° and 1600° F. In the first three of such stands the work rolls typically are subjected to strip temperatures above about 1800° F.

In evaluating the performance of the rolls during and at the conclusion of the rolling, the rolls of this invention (B) and the high-chromium rolls (A) were nearly equivalent in tons rolled/0.001 inch dressing. In the second finishing stand, where the predominant mechanism of wear is by thermal fatigue, the roll of this invention was superior. That is, Roll B was found to be much less sensitive to thermal conditions in the mill. Where abrasive wear predominates, the high-chromium rolls (A) fared better. However, it is misleading to compare hot strip mill roll performance based strictly on wear rates. Since strip quality must be considered, the surface breakdown by roughening or banding is often the limiting factor. For example, in the fifth stand the high-chromium rolls (A) became very rough after rolling about 1300 tons (approximately 155,000 lineal feet). In contrast to this, the rolls of this invention (B) produced as much as 2100 tons (263,430 lineal feet) of tinplate exhibiting fairly even, light wear with minimal light banding.

It was discovered during the evaluation of a later trial that the results of the 17 week trial were not representative of the differences in performance of the two types of rolls on a commercial hot mill. The results were not representative in that the mill experienced only one cobble during the entire trial. As the product mix on a mill begains to vary in composition, more particularly in gauge and width, the frequency of cobbles goes up. The high-chromium rolls (A) are quite sensitive to such cobbles as evidenced by the level of firecracking. This necessitates cut-downs of as much as 0.150 inches. A typical dressing is about 0.020 inches, or in the range of 0.015 to 0.35 inches.

In another series covering a twenty week rolling trial, the performances of the roll of this invention (B) and the high-chromium roll (A) were compared on products ranging between 35 and 75 inches wide, gauges between .080 and 0.375 inches, and carbon contents between 0.10 and 0.27%. The results, based on an average performance of the rolls in the second through fifth stands, are listed in Table II.

TABLE II

| | Type Roll | |
|---|---|---|
| | A-High-Chromium | B-Invention |
| Tons Rolled per .001" Wear | 309 | 563 |
| Tons Rolled per .001" Dressing | 109 | 172 |

TABLE II-continued

| | Type Roll | |
|---|---|---|
| | A-High-Chromium | B-Invention |
| Footage Rolled per .001" Wear | 13,576 | 21,827 |
| Footage Rolled per .001" Dressing | 4,815 | 6,652 |

It will be evident from a review of Table II that the rolls of this invention (B) wore significantly less than the high-chromium rolls (A). For example, the lineal feet rolled per 0.001 inches of diameter loss in dressing for Roll B averaged 38% more than for Roll A.

For another comparison of the two types of rolls, a roll of this invention (B) and a high-chromium roll (A) were matched in diameter and used ten times as a pair in the third stand for heavy sheet rolling. A comparison of the tons/.001 inches of wear and dressing respectively for each roll is listed below in Table III. Roll B consistently wore less than Roll A. Roll B was in the bottom position for six of the ten rollings. Because of the roll cooling system on this mill the bottom roll tends to wear faster since it runs hotter than the top roll. Also, comparing the tons rolled per 0.001 inches of dressing for Roll B and the Roll A, when both rolls were in a top position or when both rolls were in the bottom, Roll B produced more tons of product rolled per unit reduction in dressing.

The fact that more tons were rolled on the average with the Roll B in the top position is not particularly meaningful since the length of the rolling was frequently determined by factors other than the condition of this particular pair of rolls. A more meaningful comparison can be made by comparing the relative wear per unit dressing of the two rolls, see column four of Table III.

TABLE III

| Roll and Position | Avg. Tons Rolled | Avg. Wear | Tons Rolled per .001" Wear | Avg. Dressing | Tons Rolled per .001" Dressing |
|---|---|---|---|---|---|
| B - Top | 4346 | .008 | 543 | .021 | 207 |
| A - Bottom | 4346 | .014 | 310 | .024 | 181 |
| (4 Rollings) | | | | | |
| B - Bottom | 3469 | .005 | 694 | .024 | 145 |
| A - Top | 3469 | .008 | 433 | .022 | 158 |
| (6 Rollings) | | | | | |
| Average (10 Rollings) | | | | | |
| & B | 3820 | .006 | 637 | .023 | 166 |
| A | 3820 | .010 | 382 | .023 | 166 |

With the discovery that composite martensitic nodular graphite chill cast iron rolls are thermal crack resistant when subjected to work pieces heated and worked at temperatures above about 900° F. more particularly 1600° F, and even above as high as 1800° F, significant improvements in the usable life of a work roll were realized.

We claim:

1. In a process of hot rolling ferrous and ferrous alloy products which products are heated to temperatures in excess of 1900° F and subsequently rolled at temperatures between about 900° F and the temperature of such initial heating, the improvement comprising in combination therewith the use of a thermal crack resistant composite work roll to effect said rolling, said composite work roll characterized by 1. a surface portion having a hardness of at least 76 Shore-C and consisting essentially of, by weight, about 3.00 to 3.70% carbon, about 0.35 to 1.25% manganese, about 1.0 to 2.0 silicon, about 3.75 to 5.75% nickel, about 0.75 to 1.35% chromium, about 0.40 to 1.10% molybdenum, about 0.03 to 0.08% magnesium, the balance iron and incidental impurities, and 2. a core portion comprising a ferrous alloy whose chemistry and mechanical properties are metallurgically compatible with the chemistry and properties of said surface portion.

2. The process according to claim 1 wherein the hot rolling is effected at temperatures above about 1600° F.

3. The process according to claim 1 wherein the carbon is about 3.10 to 3.40%, manganese about 0.45 to 0.75%, silicon about 1.35 to 1.65%, nickel about 3.90 to 4.30%, chromium about 0.90 to 1.30%, and the molybdenum about 0.55 to 0.80%.

4. The process according to claim 1 wherein the surface portion has a hardness of at least 80 Shore-C.

5. The process according to claim 2 wherein the hot rolling is effected at temperatures above about 1800° F.

* * * * *